US008579137B2

(12) United States Patent
Lustenberger et al.

(10) Patent No.: US 8,579,137 B2
(45) Date of Patent: Nov. 12, 2013

(54) PACKAGING UNIT WITH A PLASTIC BOTTLE AND A FOIL BAG ARRANGED THEREIN

(75) Inventors: Stefan Lustenberger, Gensingen (DE); Stephan Kurtze, Ingelheim am Rhein (DE)

(73) Assignee: Boehringer Ingelheim International GmbH, Ingelheim am Rhein (DE)

( * ) Notice: Subject to any disclaimer, the term of this patent is extended or adjusted under 35 U.S.C. 154(b) by 118 days.

(21) Appl. No.: 13/056,528

(22) PCT Filed: Jul. 30, 2009

(86) PCT No.: PCT/EP2009/059905

§ 371 (c)(1),
(2), (4) Date: Mar. 9, 2011

(87) PCT Pub. No.: WO2010/012815

PCT Pub. Date: Feb. 4, 2010

(65) Prior Publication Data

US 2011/0266244 A1 Nov. 3, 2011

(30) Foreign Application Priority Data

Aug. 1, 2008 (EP) ..... 08161657

(51) Int. Cl.
*B65D 90/02* (2006.01)

(52) U.S. Cl.
USPC ..... 220/62.21; 206/528; 206/540; 206/814; 206/828; 215/6; 215/231; 222/95; 222/209; 222/386.5

(58) Field of Classification Search
USPC ..... 220/62.21; 215/6, 231; 206/528, 540, 206/814, 828; 222/95, 209, 386.5
See application file for complete search history.

(56) References Cited

U.S. PATENT DOCUMENTS

| | | | | |
|---|---|---|---|---|
| 4,454,945 | A * | 6/1984 | Jabarin et al. | 206/524.3 |
| 4,865,224 | A | 9/1989 | Streck | |
| 5,096,078 | A * | 3/1992 | McQueeny | 215/231 |
| 6,257,429 | B1 * | 7/2001 | Kong | 215/11.3 |
| 2002/0168401 | A1 | 11/2002 | Kanios et al. | |
| 2006/0151494 | A1 | 7/2006 | Nakamura | |
| 2008/0012172 | A1 | 1/2008 | Merical et al. | |
| 2008/0156391 | A1 | 7/2008 | Behar | |

FOREIGN PATENT DOCUMENTS

| | | |
|---|---|---|
| DE | 4445729 | 7/1996 |
| DE | 29514754 | 10/1997 |
| DE | 102008016789 | 10/2009 |
| FR | 1316596 | 2/1963 |

(Continued)

OTHER PUBLICATIONS

International Search Report, Form PCT/ISA/210, for corresponding PCT/EP2009/059905; date of mailing: Dec. 10, 2009.

*Primary Examiner* — Anthony Stashick
*Assistant Examiner* — Elizabeth Volz
(74) *Attorney, Agent, or Firm* — Michael P. Morris; Mary-Ellen M. Devlin

(57) ABSTRACT

In the case of a packaging unit comprising a plastic bottle (2) with a flexible foil bag (3) arranged therein, wherein a hollow interspace (5) is formed at least in certain regions between the surface of the inner wall of the plastic bottle (2) and the outer surface of the foil bag (3), the foil bag (3) is designed such that it at least partially automatically elastically contracts and/or can be compressed at least in certain regions by a force effected by a means arranged in the interspace (5) and/or can be collapsed.

7 Claims, 1 Drawing Sheet

(56) References Cited

FOREIGN PATENT DOCUMENTS

Figure 1:
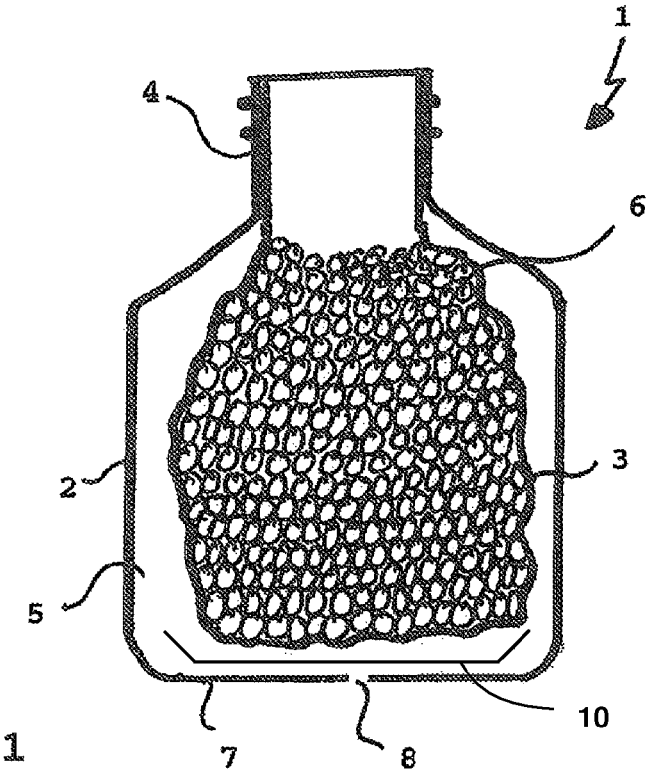

| | | | |
|---|---|---|---|
| JP | 02081651 | U | 6/1990 |
| JP | 06135471 | | 5/1994 |
| JP | 2001010666 | A | 1/2001 |
| JP | 2001348062 | A | 12/2001 |
| JP | 2004090971 | A | 3/2004 |
| JP | 2005038803 | A | 2/2005 |
| WO | 9736800 | A1 | 10/1997 |

* cited by examiner

PACKAGING UNIT WITH A PLASTIC BOTTLE AND A FOIL BAG ARRANGED THEREIN

The invention relates to a packaging unit comprising a plastic bottle with a flexible foil bag arranged therein, where a hollow space is formed at least in some areas between the inner wall surface of the plastic bottle and the outer surface of the foil bag. In addition, the invention relates in a number of alternative aspects to a process for producing a packaging unit comprising a plastic bottle with a flexible and/or elastic foil bag arranged therein, where an intermediate space is formed at least in some areas between the inner wall surface of the plastic bottle and the outer surface of the foil bag.

So-called bag-in-bottle packages in which a flexible foil bag is arranged inside a plastic bottle are used in the pharmaceutical industry. Thus, for example, nasal spray packages are known in which the pharmaceutical nasal spray active substance formulation is contained in liquid form in the foil bag and is dispensed through a spray opening when required. Thanks to the collapsing inner bag and the liquid contained in the foil bag, no air can get into the bag as a dose is taken out, with the result that over time the bag collapses and is optionally compressed within the plastic bottle. Pressure equalisation takes place in the intermediate space between the outer wall surface of the foil bag and the inner wall surface of the plastic bottle, in the space surrounding them.

A generic package is also known from DE 32 46 888 A1. This describes a package for wine in which a flexible foil bag is filled with wine. This flexible foil bag is surrounded by a plastic bottle, while a hollow intermediate space is formed between the outer wall of the foil and the inner wall of the plastic bottle. This hollow intermediate space is filled with a gas, which may also be contained in a foam plastic. The layer of gas is intended to prevent oxygen from diffusing through the foil bag into the liquid contained therein.

The packages known from the prior art operate extremely well in conjunction with liquid product packaged therein as packaged goods. However, in the pharmaceutical industry, there is also a need for packages and packaging units with which pharmaceutical active substance formulations can be sold and marketed in tablet form, as coated tablets or as filled capsules. Thus, it is known for example to package preparations of pharmaceutical active substance formulations of this kind in plastic bottles. The plain or coated tablets or filled capsules are packed in the plastic bottles in loose form. The disadvantage of this is that vibrations, knocks or impact that may occur while the packages are being transported, or if a package falls and strikes a hard surface, lead to breakage of the tablets or deformation of the capsules. These outcomes may be on the one hand the result of the impact, vibrations or knocks being transmitted directly from the wall of the bottle to the plain or coated tablets or capsules in the plastic bottle, and on the other hand the result of the plain or coated tablets or capsules knocking against one another in such circumstances. To avoid tablet breakage and capsule deformation, additionally, air-filled bags or cushions or cotton wool are placed in the plastic bottle, in order to attenuate and cushion any external impact and protect the plain or coated tablets or capsules. It is also known to use closures with spring elements disposed thereon, the spring elements pressing on the respective packaged goods in the form of plain or coated tablets or capsules when the closures are closed, thus stabilising their position within the plastic bottle.

These provisions are still not entirely satisfactory in terms of stabilising the contents of the package, as it is generally still possible for the individual plain or coated tablets or capsules to move relative to one another. Furthermore, there is room for improvement in the damping or cushioning of impact acting from outside, as damage to the contents of the package in the form of broken tablets or misshapen capsules still occurs.

The aim of the invention is to provide a packaging unit for pharmaceutical packaged goods in the form of plain or coated tablets or capsules, which ensures improved protection of the packaged goods in transit and prevents tablet breakage or capsule deformation.

In a packaging unit of the kind mentioned hereinbefore this aim is achieved according to the invention by the fact that the foil bag is designed automatically to at least partly retract elastically and/or be compressible and/or collapsible at least in some areas by the action of a means disposed in the intermediate space.

The invention makes it possible to arrange the pharmaceutical active substance formulation in the form of plain or coated tablets or capsules, hereinafter referred to individually and jointly as packaged goods, in a flexible, preferably elastic foil bag. This inner bag can be stretched and expanded within the plastic bottle before being filled with the active substance formulation, so that after being filled it automatically contracts elastically. This contraction causes the packaged goods disposed therein to be pressed gently against one another, thereby preventing the individual plain or coated tablets or capsules from moving relative to one another thereafter. Naturally, the force exerted by the elasticity of the foil bag is only sufficient to cause the packaged goods to abut on one another without being destroyed or deformed. As the foil bag contracts, a hollow intermediate space is formed between the outer surface of the foil bag and the inner wall surface of the plastic bottle surrounding it, this intermediate space ensuring that there is a spacing between the packaged goods and the inner wall of the plastic bottle, so that in the event of gentle shocks acting on the packaging unit their effect is not even transmitted to the packaged goods. Additionally, and in supplementary fashion, a means may be provided in the hollow intermediate space which exerts a force that is gentle but sufficient for the compression or collapse of the foil bag as packaged goods are removed. Whereas according to the first aspect of the invention the foil bag is designed to retract elastically automatically, so that it shrinks as packaged goods are progressively removed from it, this is not essential according to the second aspect of the invention, as in this case the force applied by the means provided in the intermediate space causes the foil bag to collapse as the packaged goods are removed.

In both cases, the presence of the intermediate space formed between the outer surface of the foil bag and the inner wall surface of the plastic bottle ensures that vibrations or shocks are only transmitted to the packaged goods to a limited extent. This ensures improved protection in transit and the incidence of broken tablets or misshapen capsules is reduced.

These advantages can be obtained all the more if the foil bag envelops the packaged goods contained therein so as to press them against one another and clings to the packaged goods.

As a result of these measures, the packaged goods are held compactly in the plastic bottle and it is impossible for individual items to damage one another by relative movement. This results in improved product stability in the presence of vibrations, e.g. in transit or when dropped, particularly thanks to the buffering between the foil bag and the wall of the plastic bottle that is achieved by means of the air-filled intermediate space or by means of the intermediate space provided with a means. In order to retain these advantages even while packaged goods are being removed from the foil bag, it is advantageous if the foil bag is designed and/or arranged to contract and/or collapse and/or be compressed by an amount corresponding to the removal of the packaged goods, at least until a certain proportion of packaged goods has been removed.

In order to intensify the buffer effect between the foil bag and the inner wall of the plastic bottle, the intermediate space in conjunction with the foil bag conveniently forms a damping and/or cushioning means that cushions and/or absorbs impact or knocks. Alternatively, a damping and/or cushioning means that cushions and/or absorbs impact or knocks is provided in the intermediate space, at least in some areas. A damping and/or cushioning means of this kind may take a wide variety of forms and be produced in many different ways. Particularly advantageous are means which expand the hollow intermediate space following the progressive removal of packaged goods and at the same time compress the foil bag. Therefore, according to another alternative embodiment, the intermediate space is filled with a means that applies the foil bag to packaged goods contained therein and, as the packaged goods are removed, expands the intermediate space and in particular compresses the foil bag.

According to a further feature the means consists of a gas, particularly air or an inert gas, that is arranged in the intermediate space preferably under excess pressure. Alternatively, the means consists of an insert of elastically compressible material arranged in the intermediate space, preferably a foam or foam material, particularly an open-celled foam which then decompresses, i.e. expands, as the packaged goods are removed.

According to another alternative embodiment the means consists of a spring element arranged in the intermediate space and preferably bearing on the base of the plastic bottle, particularly in the form of a spring element comprising spring arms that are spread out starting from a central point. The spring element may also be a concertina-like cushioning means or a concertina pad or a padded cushion filled with air or gas. The size of the spring element in question is matched to the particular size of the plastic bottle.

For producing the foil bag, the elastically compressible material or the spring element, all kinds of plastic materials may be used. It is particularly advantageous according to a further embodiment of the invention for the foil bag and/or the elastically compressible material and/or the spring element to be made of a polyurethane elastomer, a cellular polyurethane elastomer, a thermoplastic material, particularly of high density polypropylene or polyethylene, or a foil laminate. For the foil bag it is possible to use plastic films made of polyvinylchloride (PVC), cyclo-olefin-copolymer (COC), polychlorotrifluoroethylene (PCFE), polyethylene (PE), polypropylene (PP), polyethylene terephthalate (PET), polycarbonate (PC), polyester (UP), polyacrylate, polyamide (PA) or another plastic or a multi-layer composite plastic film, consisting for example of a combination of polychlorotrifluoroethylene (PCTFE), which is known particularly by the brand name Aclar® registered as a trade mark by Honeywell International, Inc., with polyvinylchloride (PVC) or polyvinyl chloride (PVC) with polyvinylidene chloride (PVdC), or alternatively laminate films of these materials, or in the form of aluminium films or composite aluminium films.

To ensure that a pressure equalisation takes place in the hollow intermediate space as packaged goods are progressively removed from the foil bag, but also to enable a negative pressure or vacuum to be applied to this intermediate space during the manufacture of the packaging unit, if required, the plastic bottle preferably comprises a ventilation pathway that connects the intermediate space to the outer atmosphere, while preferably the plastic bottle is provided with a valve arranged in particular in the wall of the plastic bottle with a connection to the intermediate space. Through the valve, for example, the intermediate space may be filled with a gas under pressure.

As already mentioned, the packaging unit may be used in particular for filling with individual packaged goods and in this case especially as packaging for plain or coated tablets or filled capsules. Expediently, therefore, the foil bag is filled with a pharmaceutical active substance formulation in the form of plain or coated tablets or filled capsules as the packaged goods.

As pharmaceutical active substance formulations are often sensitive to moisture, a desiccant is advantageously disposed in the intermediate space. The hollow intermediate space is intended for the provision of a desiccant. A suitable desiccant is silica gel, for example.

The problem stated above is also solved by various processes for producing a packaging unit.

The problem on which the invention is based is solved, in a first process for producing a packaging unit comprising a plastic bottle with a flexible and/or elastic foil bag arranged therein, wherein an intermediate space is formed at least in some areas between the inner wall surface of the plastic bottle and the outer surface of the foil bag, in that the plastic bottle is provided with a foil bag arranged therein, thereby forming an intermediate space, a negative pressure is applied to the intermediate space such that the foil bag clings to the inner wall of the plastic bottle at least in some areas, particularly with at least partial expansion of its wall surface, the foil bag is filled with a pharmaceutical active substance formulation in the form of plain or coated tablets or filled capsules as packaged goods which can be removed therefrom and subsequently the negative pressure applied is removed.

The sequence of individual process steps results in a package in which the initially expanded foil bag contracts again once the negative pressure has been removed and in this way the intermediate space that provides the buffering is formed. The packaging unit thus produced then has the advantages listed hereinbefore.

In this process it is possible for the intermediate space subsequently to be filled with a desiccant and/or with a gas, particularly under excess pressure, thereby advantageously improving the buffering effect of the intermediate space as already stated above.

Moreover it is possible for a desiccant and/or a spring element and/or an insert of elastically compressible material to be introduced into the intermediate space before the negative pressure is applied.

The problem on which the invention is based is solved, in a second process for producing a packaging unit comprising a plastic bottle with a flexible and/or elastic foil bag arranged therein, in which an intermediate space is formed at least in some areas between the inner wall surface of the plastic bottle and the outer surface of the foil bag, in that the plastic bottle is provided with a foil bag disposed therein, thus forming the intermediate space, the foil bag is filled with pharmaceutical active substance formulation in the form of plain or coated tablets or filled capsules as the packaged goods which can be removed therefrom, and subsequently the intermediate space is filled with a gas, preferably under excess pressure, particularly in such a way that the foil bag is applied at least in some areas to the packaged goods and as the packaged goods are removed the foil bag is compressed by an amount corresponding to the removal of the packaged goods.

In this way the intermediate space is formed on the one hand as a damping and/or cushioning means that provides the buffering and on the other hand as a means that brings about the compression of the foil bag as the packaged goods are removed. The advantages associated with the packaging unit thus produced are the same as those mentioned previously with regard to the packaging unit according to the invention.

Expediently, a desiccant is provided in the intermediate space before it is filled with the gas.

Finally, the problem on which the invention is based is solved by a third process for producing a packaging unit comprising a plastic bottle with a flexible and/or elastic foil bag arranged therein, where an intermediate space is formed at least in some areas between the inner wall surface of the plastic bottle and the outer surface of the foil bag, characterised in that the plastic bottle is provided with a foil bag arranged therein so as to form the intermediate space, a spring element and/or an insert of elastically compressible material is or are disposed in the intermediate space and the foil bag is filled with pharmaceutical active substance formulation in the form of plain or coated tablets or filled capsules as packaged goods that can be removed therefrom, such that the spring element and/or the insert is or are compressed.

This also results in a packaging unit in which the intermediate space is embodied as a damping or cushioning means that provides the buffering. The compressible material or the spring element disposed in the intermediate space is compressed during filling by the weight of the packaged goods and then expands because of its elastic properties during the removal of the packaged goods in accordance with the resultant reduction in the weight acting on the material and/or the spring element. The packaging unit produced in this way also has the advantages listed hereinbefore.

Expediently, a desiccant is introduced into the intermediate space before and/or after the introduction of the spring element and/or the insert and negative pressure is applied to the intermediate space particularly during the filling of the foil bag. The negative pressure assists the compression of the elastic insert or the spring element.

It will be understood that the features mentioned above and about to be explained hereinafter may be used not only in the particular combination specified but also in other combinations. The scope of the invention is defined only by the claims.

Figure 2:
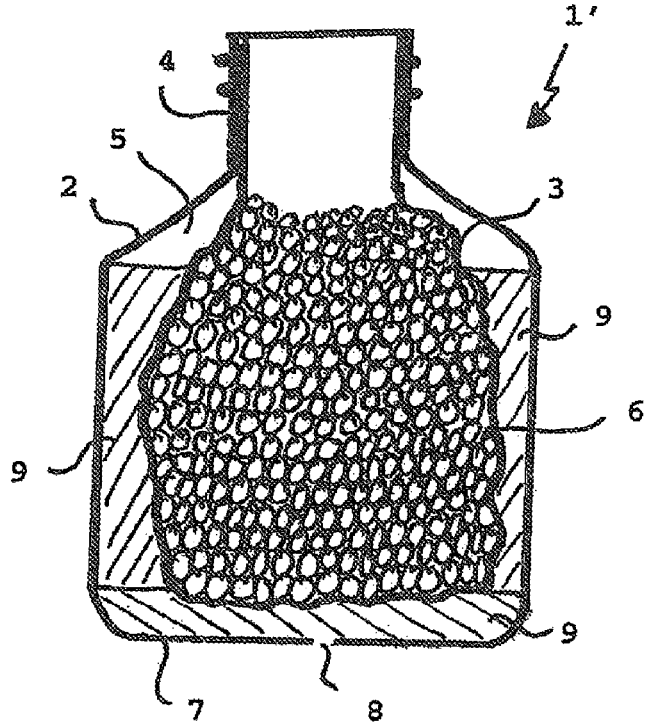

The invention is hereinafter explained in more detail by means of embodiments by way of example, with reference to the associated drawings, wherein:

FIG. 1 is a schematic longitudinal section through a first embodiment of a packaging unit according to the invention and FIG. 2 is a schematic longitudinal section through a second embodiment of a packaging unit according to the invention.

The packaging units 1 and 1' shown in FIGS. 1 and 2 differ only in the construction of a damping or cushioning means. Therefore, identical elements or objects in the two embodiments have been given the same reference numerals.

The packaging unit 1 according to FIG. 1 consists of a plastic bottle 2 and a foil bag 3 arranged therein, made from a flexible material. The plastic bottle 2 has a neck-like mouth opening 4 to the inside of which the foil bag 3 is attached by welding, gluing or sealing. Between the outer wall of the foil bag 3 and the inner wall surface of the plastic bottle 2, a hollow intermediate space 5 is formed at least in some areas outside the mouth region 4. A pharmaceutical active substance formulation in tablet form is provided in the foil bag 3 as the packaged goods 6. The foil bag 3 envelops the packaged goods 6 contained therein, clings to the outside of the agglomerate formed by the tablets and holds it together so that the individual tablets are pressed gently against one another. The foil bag 3 is furthermore constructed and/or arranged in the intermediate space 5 or in the plastic bottle 2 such that when the packaged goods 6 are removed it adapts flexibly and automatically to the remaining volume of packaged goods and contracts and/or is compressed. For this purpose the foil bag 3 is elastically expandable, for example, with the result that after being filled with the packaged goods 6 it takes up the position shown in FIG. 1 and as the packaged goods are removed it automatically contracts again as a result of the expansion that has taken place during filling, in an amount corresponding to the removal of the packaged goods. To allow equalisation of pressure to take place in the intermediate space 5 for this movement of the foil bag 3, an opening 8 is formed in the base wall 7 of the plastic bottle 2, forming a ventilation pathway from the intermediate space 5 to the outer atmosphere surrounding the plastic bottle 2. The elastic expansion of the foil bag 3 can be obtained by producing a negative pressure in the intermediate space 5 through the opening 8 before the foil bag 3 is filled with the packaged goods 6 and as a result the foil bag 3 is expanded and stretched from its relaxed starting position to the extent that it abuts with its outer surface on the inner wall surfaces of the plastic bottle 2. After the foil bag 3 has been filled with the packaged goods 6 the negative pressure or vacuum is removed, with the result that the foil bag 3 contracts into the position shown in FIG. 1. The intermediate space 5 filled with air and the spacing of the foil bag 3 from the inner wall surface of the plastic bottle 2 produced by the intermediate space 5 provide protection for the packaged goods 6 in transit and a buffering effect against shocks or vibrations acting on the plastic bottle 2 from the outside.

To improve the damping or cushioning effect, an optionally multi-part insert 9 of elastically compressible material may be provided in the intermediate space 5, as shown in FIG. 2. As the foil bag 3 is filled with the packaged goods 6, this material is then compressed by the weight of the goods 6, but optionally also assisted by a vacuum that is additionally produced in the intermediate space 5. The elastic insert 9 thus has an additional damping or cushioning effect on shocks, impact or vibrations acting on the plastic bottle 2 from outside. As packaged goods 6 are now taken from the foil bag 3, the insert 8 automatically expands and compresses the foil bag 3 accordingly, i.e. exerts a force on the foil bag 3 in the form of pressure from outside. In this case, the foil bag 3 does not have to consist of an elastic material; it is sufficient if the foil bag 3 is made of a flexible material and is collapsible in its design.

An elastic spring element, for example produced by injection moulding, may also be arranged in the intermediate space 5 in a manner not shown here, to cushion the foil bag 3 while it is being filled and compress it or at least support it in its collapsing movement as the packaged goods are removed. A spring element of this kind is preferably arranged on the inside of the bottle on the base wall 7. Instead of or in addition both to the elastically compressible insert 9 and also to the spring element if provided, the intermediate space 5 may be filled with a gas, for example air or an inert gas, particularly under excess pressure, before or preferably after the foil bag 3 is filled with the packaged goods. For this purpose, a valve (not shown here) is provided in the opening 8 to close it off, and through this valve the intermediate space 5 can be filled with the gas. As a result of this measure the intermediate space 5 is additionally formed as an air cushion, which leads to a further reduction in the susceptibility to external knocks or vibrations. In this case, too, the pressure conditions in the intermediate space 5 can be adjusted so as to assist or bring about the collapsing movement of the foil bag 3 as packaged goods are removed.

Alternatively, a spring element 10 (see FIG. 1) may be disposed in the intermediate space 5 resting on the base wall 7 of the plastic bottle 1. The spring element 10 may have spread-out spring arms extending from a central point which apply a force to, and cause, the flexible foil bag 3 to automatically contract, to compress, and collapse at least in some areas.

As a result of these embodiments, overall, the intermediate space 5 in conjunction with the foil bag 3 is constructed as a damping and/or cushioning means which cushions and/or absorbs shocks or impact, while a damping and/or cushioning means which cushions and/or absorbs impact or shocks is disposed at least in some areas of the intermediate space. These means may be the insert 9 of elastically compressible material, a gas that is introduced into the intermediate space 5 particularly under excess pressure or a spring element which rests on the base wall 7 of the plastic bottle 2. The spring element may in particular comprise spring arms which are spread open and proceed from a central point. The elastically compressible material of the insert 9 is preferably a foam or a foam material, particularly with an open-celled structure.

The plastic bottle 2 may be made of any common conventional plastics which are suitable and permitted for the packaging of pharmaceutical active substance formulations.

Likewise, the foil bag 3 may be produced from conventional foil materials provided that they are guaranteed to be collapsible and their fill volume can be reduced substantially as the packaged goods are removed.

In order to produce the packaging unit, the foil bag 3 and plastic bottle 2 can be produced together in a coextrusion process, the intermediate space 5 then subsequently being filled with a gas and optionally placed under pressure, before or after the foil bag is filled with packaged goods 6. However, it is also possible to produce the foil bag 3 and plastic bottle 2 separately from one another and then introduce the foil bag 3 into the plastic bottle 2 afterwards. It is also possible for the plastic bottle 2 to be produced initially without a base wall 7, then to insert the foil bag 3 from the base and attach it with its mouth opening in the mouth region 4 of the plastic bottle 2, after which the insert 9 of elastically compressible material is introduced and then the plastic bottle 2 is sealed up by welding or gluing or bonding the base wall 7 thereto.

Moreover, a desiccant may also be introduced into the intermediate space 5, to prevent the packaged goods 6 from being affected by the effects of moisture.

The intermediate space 5 which is present between the inner wall surface of the plastic bottle 2 and the outer surface of the foil bag 3 does not have to be continuous in form. It is also possible for the intermediate space 5 to have individual sections, each formed as cushioning or damping means or each provided with a cushioning or damping means. In this case, the term "intermediate space" then optionally relates to an intermediate space section. In particular, when producing the plastic bottle 2 and foil bag 3 by a coextrusion process it is also possible to form the base wall 7 of the plastic bottle 2 and the closure side of the foil bag 3 that faces the base wall 7 as a combined unit, thereby dividing the intermediate space 5 within the plastic bottle 2 into two opposing sections or regions.

The invention claimed is:

1. A packaging unit, comprising:

a plastic bottle;

a flexible foil bag arranged in the plastic bottle, where a hollow intermediate space is formed at least in some areas between an inner wall surface of the plastic bottle and an outer surface of the foil bag, and where the foil bag is configured so as to automatically contract elastically at least partly, to be compressible, and collapsible at least in some areas; and a spring element disposed in the intermediate space resting on a base wall of the plastic bottle, the spring element having spread-out spring arms extending from a central point which apply a force to, and cause, the flexible foil bag to automatically contract, to compress, and collapse at least in some areas.

2. The packaging unit according to claim 1, wherein:

the foil bag envelops packaged goods contained therein so that they press against one another, and clings to the packaged goods the foil bag is designed to at least one of contract, collapse, and be compressed in accordance with the amount of packaged goods removed, at least until a certain proportion of packaged goods has been removed.

3. The packaging unit according to claim 1, wherein the intermediate space in conjunction with the foil bag forms a damping or cushioning means that cushions or absorbs impact or shocks, or a damping or cushioning means that cushions or absorbs shocks or impact is arranged in the intermediate space, at least in some areas, or the intermediate space is filled with a means that applies the foil bag to packaged goods contained therein and, when packaged goods are removed, expands the intermediate space and compresses the foil bag.

4. The packaging unit according to claim 1, wherein at least one of: the foil bag and the spring element comprises at least one of: a polyurethane elastomer, a cellular polyurethane elastomer, a thermoplastic material, and a foil laminate.

5. The packaging unit according to claim 1, wherein the plastic bottle has a ventilation pathway connecting the intermediate space to an outer atmosphere, while the plastic bottle is provided with a valve disposed in the wall of the plastic bottle, with a connection to the intermediate space.

6. The packaging unit according to claim 1, wherein the foil bag is filled with a pharmaceutical active substance formulation in the form of plain or coated tablets or filled capsules as packaged goods.

7. The packaging unit according to claim 1, wherein a desiccant is disposed in the intermediate space.

* * * * *

UNITED STATES PATENT AND TRADEMARK OFFICE

CERTIFICATE OF CORRECTION

PATENT NO. : 8,579,137 B2
APPLICATION NO. : 13/056528
DATED : November 12, 2013
INVENTOR(S) : Lustenberger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 175 days.

Signed and Sealed this
Twenty-second Day of September, 2015

Michelle K. Lee

Michelle K. Lee
*Director of the United States Patent and Trademark Office*